US005221072A

United States Patent [19]

Erickson et al.

[11] Patent Number: 5,221,072

[45] Date of Patent: Jun. 22, 1993

[54] RESILIENT HYDRAULIC ACTUATOR

[75] Inventors: Frederick L. Erickson; William E. Richeson, both of Fort Wayne, Ind.

[73] Assignee: North American Philips Corporation, New York, N.Y.

[21] Appl. No.: 820,470

[22] Filed: Jan. 14, 1992

[51] Int. Cl.[5] ..... F16K 31/124; F01L 9/02

[52] U.S. Cl. ..... 251/30.05; 251/47; 251/129.1; 123/90.12

[58] Field of Search ..... 251/30.01, 30.05, 31, 251/47, 48, 129.1; 123/90.12

[56] References Cited

U.S. PATENT DOCUMENTS

| | | | |
|---|---|---|---|
| 534,360 | 2/1895 | Collins et al. | 251/47 X |
| 655,342 | 8/1900 | Gulland | 251/47 |
| 3,226,078 | 12/1965 | Anderson | 251/31 X |
| 3,451,423 | 6/1969 | Priese | 251/31 X |
| 3,674,041 | 7/1942 | Beals | 251/31 X |
| 3,738,337 | 6/1973 | Massie | 251/30.05 X |
| 4,000,756 | 1/1977 | Ule et al. | 123/90.12 X |
| 4,831,973 | 5/1989 | Richeson, Jr. | 251/129.1 X |
| 4,974,495 | 12/1990 | Richeson, Jr. | 251/30.05 X |

*Primary Examiner*—John Rivell
*Attorney, Agent, or Firm*—Robert J. Kraus

[57] ABSTRACT

A highly efficient all hydraulic poppet valve actuator utilizes fluid spring chambers at each end of travel to store energy. Fluid in a first spring chamber is compressed and the chamber cocked by supplemental hydraulic pressure which also seats a poppet valve. A first activation device cancels this pressure to allow transit of the poppet valve and re-cocking of the second spring chamber. Return activation is caused by cancelling a fluid latch to allow transit back to an initial position which recloses the poppet valve.

10 Claims, 6 Drawing Sheets

RESILIENT HYDRAULIC ACTUATOR

SUMMARY OF THE INVENTION

The present invention relates generally to a two position, bistable, straight line motion actuator and more particularly to a fast acting actuator which utilizes fluid pressure against a piston to perform fast transit times between the two positions. The invention utilizes control valves to gate high pressure fluid to the piston and a double-ended hydraulic spring system for efficiently propelling, for example, a poppet valve back and forth.

This actuator finds particular utility in opening and closing the gas exchange, i.e., intake or exhaust, valves of an otherwise conventional internal combustion engine. Due to its fast acting trait, the valves may be moved between full open and full closed positions almost immediately rather than gradually as is characteristic of cam actuated valves. The actuator mechanism may find numerous other applications.

Internal combustion engine valves are almost universally of a poppet type which are spring loaded toward a valve-closed position and opened against that spring bias by a cam on a rotating cam shaft with the cam shaft being synchronized with the engine crankshaft to achieve opening and closing at fixed preferred times in the engine cycle. This fixed timing is a compromise between the timing best suited for high engine speed and the timing best suited to lower speeds or engine idling speed.

The prior art has recognized numerous advantages which might be achieved by replacing such cam actuated valve arrangements with other types of valve opening mechanism which could be controlled in their opening and closing as a function of engine speed as well as engine crankshaft angular position or other engine parameters.

U.S. Pat. No. 4,009,695 discloses hydraulically actuated valves in turn controlled by spool valves which are themselves controlled by a dashboard computer which monitors a number of engine operating parameters. This patent references many advantages which could be achieved by such independent valve control, but is not, due to its relatively slow acting hydraulic nature, capable of achieving these advantages. The patented arrangement attempts to control the valves on a real time basis so that the overall system is one with feedback and subject to the associated oscillatory behavior.

Other types of fluid powered valve actuators have been suggested in the literature, but have not met with much commercial success because, among other things, it is difficult and time consuming to move a large quantity of hydraulic fluid through a pipe or conduit of a significant length (more precisely, long in comparison to its cross-section). Hence, systems with lengthy connections are also plagued by lengthy response times.

For example, U.S. Pat. No. 4,791,895 discloses an engine valve actuating mechanism where an electromagnetic arrangement drives a first reciprocable piston and the motion of that piston is transmitted through a pair of pipes to a second piston which directly drives the valve stem. This system employs the hydraulic analog of a simple first class lever to transmit electromagnet generated motion to the engine valve. U.S. Pat. No. 3,209,737 discloses a similar system, but actuated by a rotating cam rather than the electromagnet.

U.S. Pat. No. 3,548,793 employs electromagnetic actuation of a conventional spool valve in controlling hydraulic fluid to extend or retract push rods in a rocker type valve actuating system.

U.S. Pat. No. 3,738,337 discloses an electrically operated hydraulically driven engine valve arrangement powered by the engine lubricating oil.

U.S. Pat. No. 4,000,756 discloses another electrohydraulic system for engine valve actuation where relatively small hydraulic poppet type control valves are held closed against fluid pressure by electromagnets and the electromagnets selectively de-energized to permit the flow of fluid to and the operation of the main engine valve.

The utilization of an opposed pair of mechanical springs to absorb energy as a poppet valve moves in one direction and subsequently release that energy to help drive the valve in the opposite direction is suggested in U.S. Pat. Nos. 4,614,170; 4,749,167; and 4,883,025. The alternative use of a pneumatic spring assembly for generally the same purpose is suggested in the lastmentioned patent as well as in U.S. Pat. No. 4,831,973.

Finally, a hydraulically powered valve actuator incorporating mechanical spring loaded hydraulic chambers to store energy for subsequent translations is disclosed U.S. Pat. No. 4,974,495.

The actuator of the present invention utilizes two hydraulic fluid spring chambers (as opposed to mechanical springs loading a hydraulic chamber as in the lastmentioned patent) to provide the main source of motive energy to open and close a poppet valve. The present invention achieves new heights of efficiency by using these hydraulic springs as preloaded devices to propel a poppet valve back and forth between its normally seated position and its fully open position. The high efficiency is achieved by capturing the energy of the previous transition to be used for the next transition. The actuator piston is initially powered into a first spring-loaded position by externally applied high pressure hydraulic fluid. The first spring comprises a chamber of fluid which has been compressed to exert a propulsion force on the actuator piston. The piston, in turn, has an even higher pressure applied to an opposite face or in a reverse direction to keep the actuator piston in a closed and latched condition. This higher pressure fluid on the opposite face of the piston must be relieved in order to release the latch and allow the first spring to open the poppet valve. To achieve this, a control valve is opened rapidly to allow the fluid in front of the advancing piston to be pumped into a second chamber. This second chamber will subsequently act as the second spring for propelling the piston back to its initial position.

Release of the latching pressure and venting of the fluid into the second spring chamber is accomplished by a three-way valve. This valve provides a direct path for the piston fluid to be pumped into the second chamber. The valve also independently blocks the high pressure fluid from the front side of the actuator piston and closes a vent from the second spring chamber to the suction side of the pump. All of these functions should be accomplished by the three-way valve at the same time in order to convert the actuator from an initial latched condition to its transit mode.

As the actuator piston continues to transit toward its open state, the second fluid chamber increase in pressure and causes the piston to slow down. Finally, the piston stops and would tend to bounce back were it not for a fluid latch which prevents any reverse motion until such time as a return valve is activated to allow an open path back into the first spring chamber. This open path cancels the return latch and allows the fluid to be compressed into the first chamber to compress the first piston fluid spring. During the return motion of the actuator piston, the three-way valve is reset. This resetting is timed to allow the following three events to occur. 1) The high pressure fluid again powers the piston to assure that the piston "pumps up" the first fluid chamber and also to assure that enough excess pressure is applied to the poppet valve to assure proper seating. 2) The second fluid spring chamber is closed off from the piston chamber. 3) A vent from the low pressure side of the hydraulic pump is opened to the second fluid spring chamber to insure the pressure in this chamber is calibrated to the suction side of the pump.

A salient feature of the present invention is the low mass actuator piston and valve assembly which leads to high speed operation as well as high efficiency.

Another salient feature of the present invention is its structurally compact design with the hydraulic spring chambers positioned very close to the working piston thereby providing minimal fluid friction paths during fluid exchange.

Among the several objects of the present invention may be noted the provision of a highly efficient all hydraulic poppet valve actuator; the provision of low mass actuator piston in a valve actuator using a closely coupled fluid source; the provision of a high speed, high efficiency valve actuating device; and overall improvements in electronically controlled hydraulically actuated valve actuator mechanisms, These as well as other objects and advantageous features of the present invention will be in part apparent and in part pointed out hereinafter.

In general, an electrically controlled hydraulically powered internal combustion engine valve actuator has a valve actuator housing and power piston reciprocable therein with a pair of opposed primary working surfaces for receiving hydraulic fluid pressure for moving the piston within the housing back and forth along an axis. There are a pair of fluid chambers or cavities within the housing of substantially the same relatively fixed volume with one chamber supplying pressurized fluid to one piston surface and the second chamber receiving fluid displaced by the other piston surface as the piston moves in one direction along the axis. The chamber roles reverse as the piston travel reverses and the second chamber supplies pressurized fluid to the other piston surface and the first chamber receives fluid displaced by the one piston surface as the piston moves in the opposite direction along the axis. Alternately, the pressure in one chamber increases as the pressure in the other chamber decreases when the piston moves in one direction and then the pressure in the other increases as the pressure in the one decreases during the return trip. A two position, three function valve is operable in one position to supply high pressure hydraulic fluid from a source to one piston surface and to connect one chamber to a low pressure hydraulic sink or return. In the other of its positions, this valve disconnects the high pressure hydraulic fluid source from the one piston surface as well as disconnecting the one chamber from the low pressure return. Thereafter, the valve couples the one chamber with the one piston surface to relieve the pressure therefrom. The other chamber contains relatively high pressure hydraulic fluid and is in fluid communication with the other piston surface when the two position valve is moved from one position to the other of its positions and powers the piston from one position to another.

Also in general and in one form of the invention, a hydraulically actuated transducer, for driving, for example, an internal combustion engine valve includes a transducer housing with a member reciprocable within the housing along an axis. The member has a pair of opposed primary working surfaces for receiving hydraulic fluid pressure for moving the member back and forth along the axis. A first hydraulic fluid control valve supplies source pressure to one working surface to maintain the member at one of its extreme positions along the axis. This control valve is selectively actuated to release the high pressure from said one working surface allowing a flow of high pressure hydraulic fluid to the other of the primary working surfaces to move the member from said one extreme position to the other.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
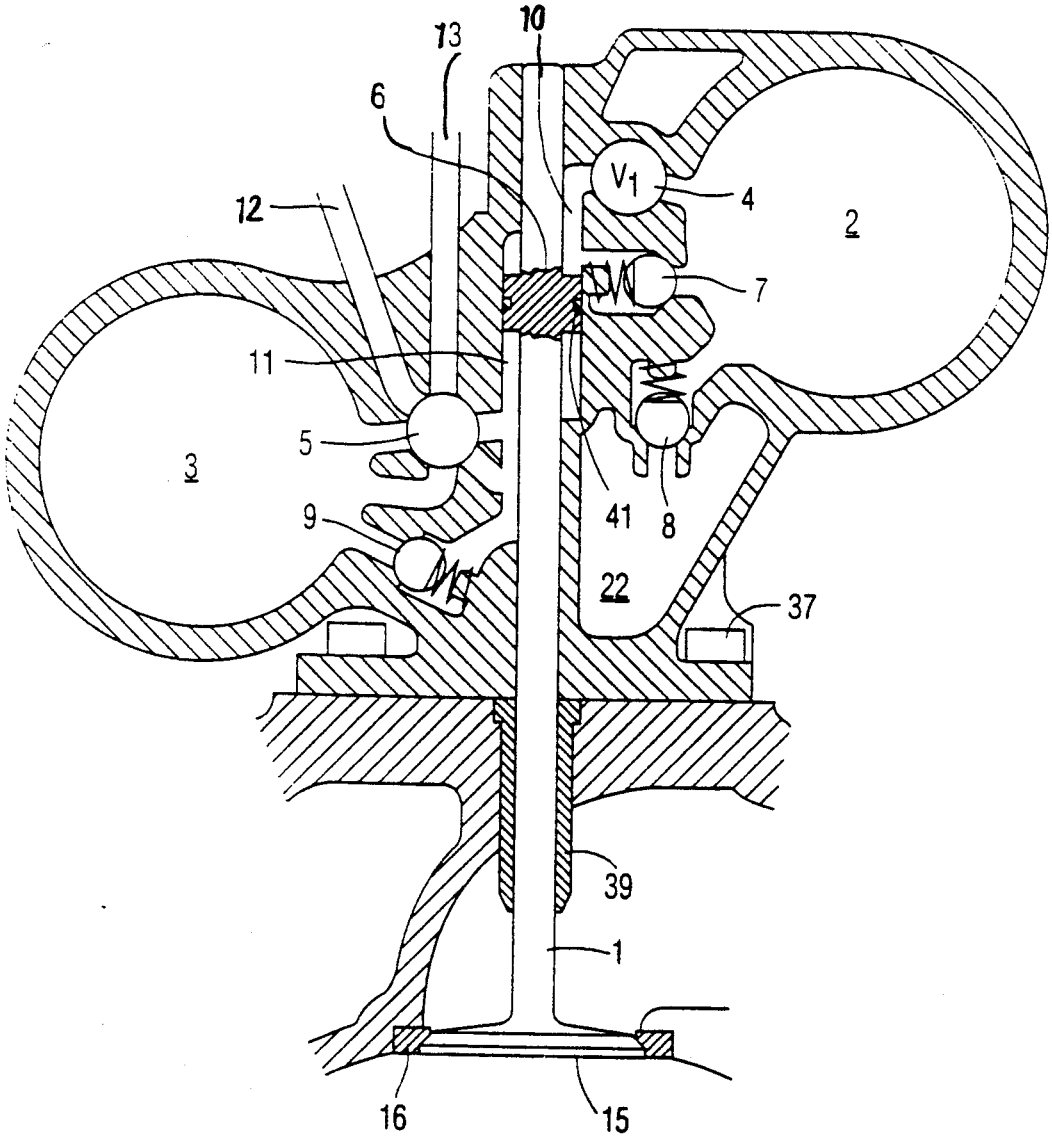
FIG. 1 is a side view in cross-section of an actuator in its initial or poppet-valve-closed position.

The actuator mechanism includes two main powered valves 4 and 5 which provide basic communication between the piston 6 cavity and hydraulic spring chambers 2 and 3. There are three other one-way ball or check valves 5, 7 and 8. In FIG. 1, the power piston 6 is in its fully up or poppet-valve-closed position with poppet valve 15 resting firmly in its seat 16. Poppet valve 15 has a valve stem 1 rigidly connected to the piston 6. The piston has a seal 41 and the valve stem is reciprocable in a guide 39. In the valve-closed position, the three-way valve 5 is in the position shown in FIG. 2 with the fluid spring chamber 3 directly connected to low pressure conduit 13 and its pressure set at, for example, 500 psi. The low pressure conduit 13 connects to the low pressure side of the hydraulic pump. The high pressure side of this pump is connected to conduit 12 and chamber 11 is therefor at, for example, 3000 psi. At the same time, chamber 2 is maintained at 2500 psi. which pressure is transmitted by way of the one-way valve 7 to the chamber 10 and the upper face of the piston 6. The 500 psi differential seating pressure below forces piston 6 upwardly to its extreme position and maintains the poppet valve firmly seated. The actuator is now cocked and ready for actuation by release of the 3000 psi pressure on the underside of piston 6.

Figure 2:
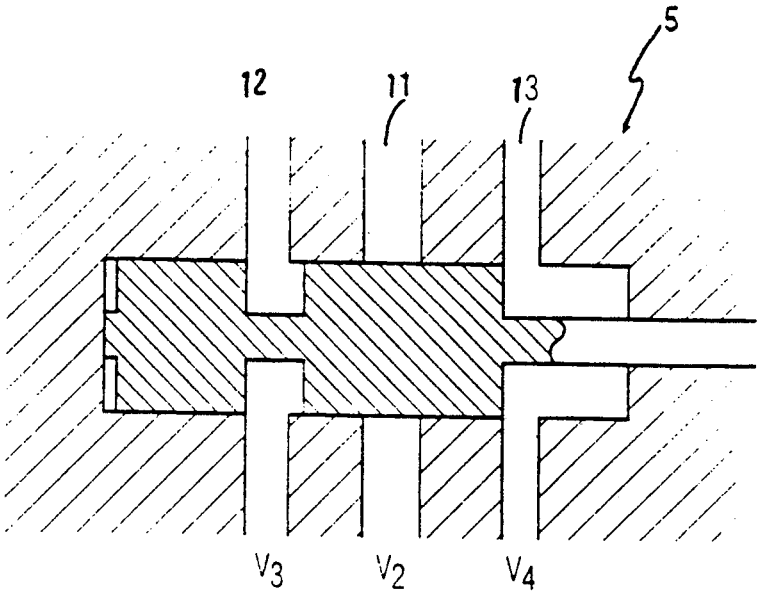
FIG. 2 is a cross-sectional view of a three-way valve in one mode.

Three-way valve 5 is effective to either connect or block diametrically opposite conduits. Thus, in the FIG. 2 position, one open diametrically opposite pair supply high pressure to the bottom face of piston 6. This is referred to as $V_3$ being open. Another pair (hereinafter $V_4$) provide communication between chamber 3 and the low pressure return. In the FIG. 3 position, these pairs are blocked, but there is communication between chamber 3 and the chamber 11 and the bottom face of the power piston 6 by way of $V_2$. FIG. 2 depicts $V_3$ and $V_4$ open and $V_2$ closed while FIG. 3 depicts $V_3$ and $V_4$ closed and $V_2$ open.

Figure 3:
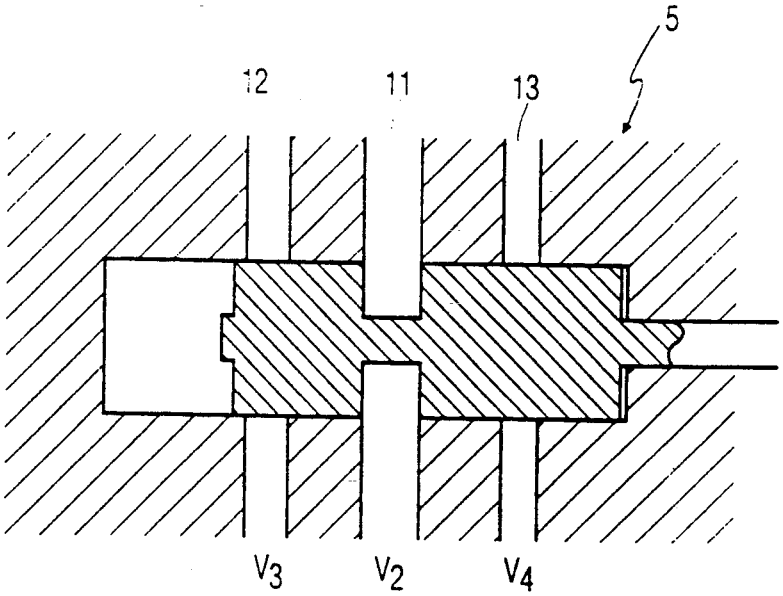
FIG. 3 is a cross-sectional view of the three-way valve of FIG. 2 in a second mode.

The actuate command causes the three-way valve 5 to transition from its FIG. 2 condition to its FIG. 3 condition closing $V_3$ preventing the application of high pressure to chamber 11; opening spring chamber 3 to piston chamber 11 by opening $V_2$; and shutting off spring chamber 3 from the 500 psi line 13 by closing $V_4$. With chamber 11 communicating with spring chamber 3, the advancing piston 6 powered by the 2500 psi pressure from spring chamber 2 pumps the fluid in chamber 11 into spring chamber 3 charging it to approximately 2500 psi. Notice that initially there will be a slight pressure adjustment when $V_2$ opens into chamber 11 during which the 3000 psi in the relatively small chamber 11 will cause a slight pressure increase in chamber 3. The three-way valve 5 is, however, configured to shut off the 3000 psi source line 12 from chamber 11 before it opens the passageway between chamber 11 and spring chamber 3. This will prevent any charging of the spring chamber 3 directly from the high pressure source.

The high pressure side of the hydraulic pump is connected to conduit 12 while the low pressure side is connected to 13. The chamber 22 is also maintained at 500 psi by connection to the low pressure side of the hydraulic pump. A one-way ball valve 8 connects chamber 22 with chamber 2 to assure that the pressure in chamber 2 never falls below 500 psi and establishes a continuous calibration so that the chamber maintains its spring pre-load at the same point.

Figure 4:
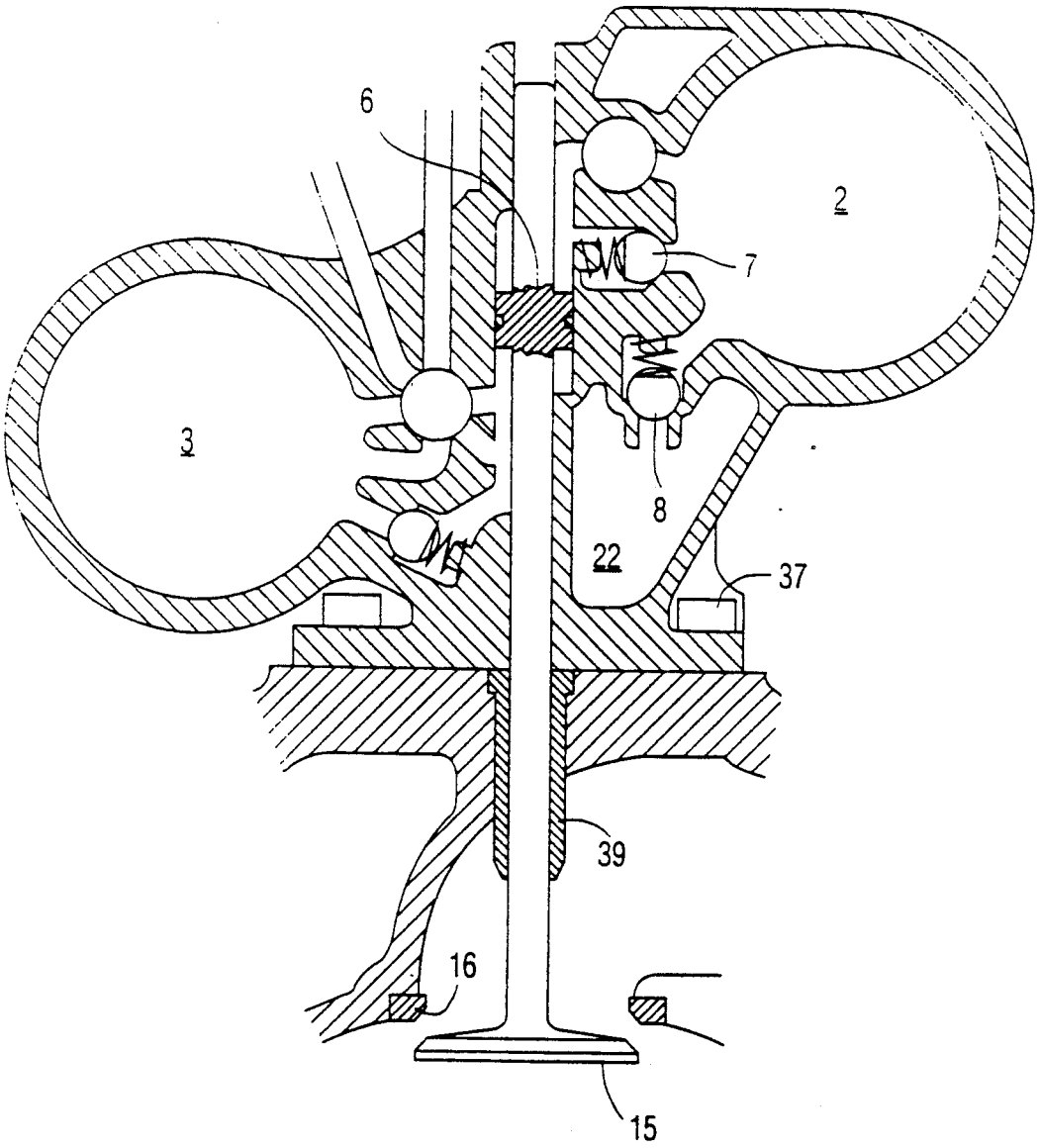
FIG. 4 is a cross-sectional view of the actuator of FIG. 1, but with the piston midway along its travel between valve-open and valve-closed positions.

In FIG. 4, the poppet valve 15 is about half-way between its closed and wide open positions and the actuator is moving at about its maximum velocity. At this time, the pressure in spring chamber 2 has decreased to about 1500 psi as it is providing the energy to charge spring chamber 3. Also, the pressure in spring chamber 3 is increasing and is beginning to slow the power piston 6 as it proceeds on its way to complete the charging of spring chamber 3.

Figure 5:
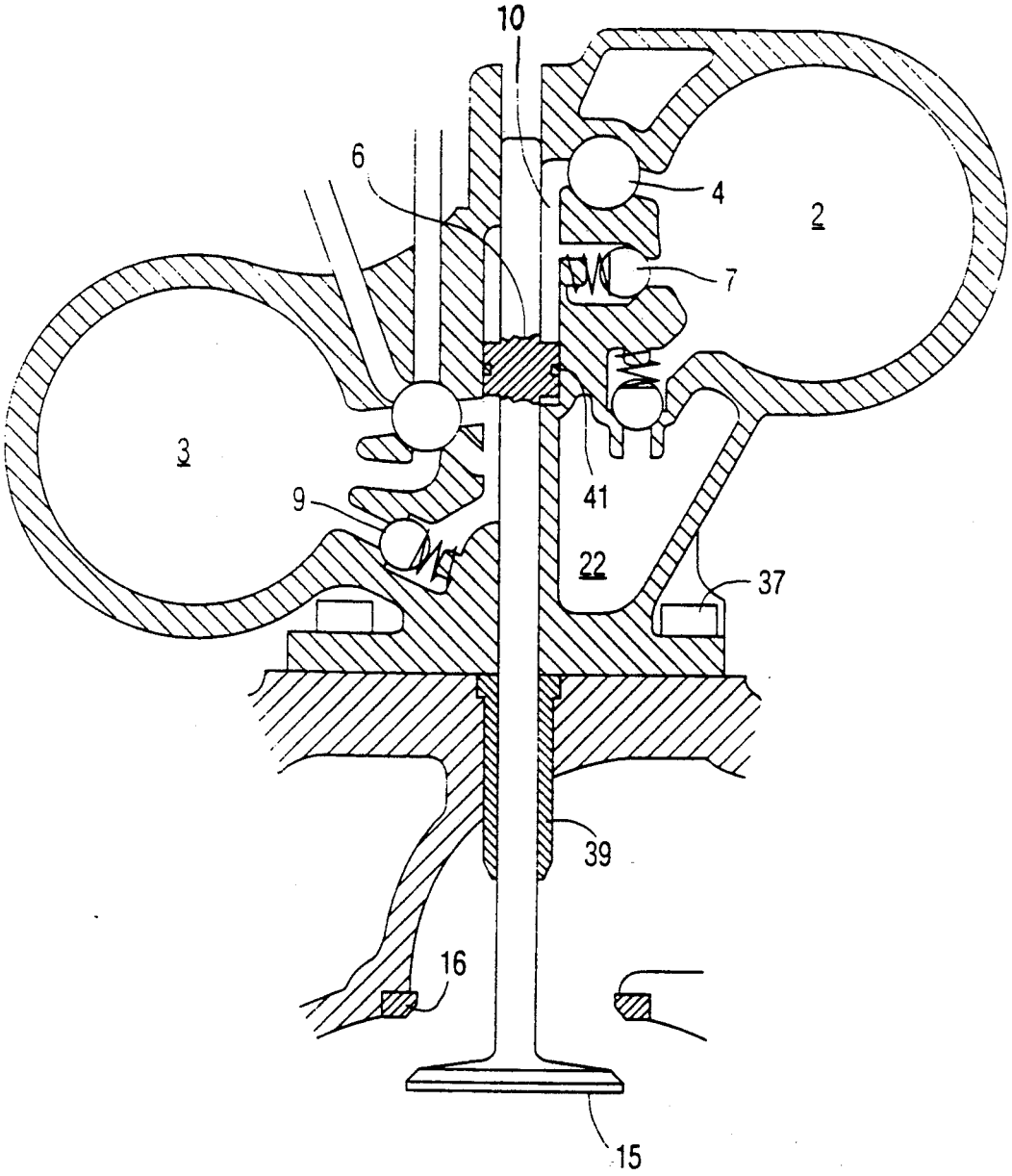
FIG. 5 is a cross-sectional view of the actuator of FIGS 1 and 4, but with the piston at the its opposite extreme of travel in the valve-open position.

In FIG. 5, the actuator piston 6 has reached its lowermost extreme and the poppet valve is wide open. In this position, spring chamber 3 has been fully charged by the advancing piston 6 to about 2500 psi. As the advancing power piston 6 comes to rest, its tendency to rebound or bounce back is arrested by an automatic hydraulic latch feature provided by ball valve 7 which prevents any back flow from chamber 10 into spring chamber 2. The actuator is now in a quiescent, stable state with the full force of the pressurized fluid in spring chamber 3 applied by way of one-way valve 9 to the lower face of piston 6. Almost all the energy pumped into spring chamber 3 is now available to return the actuator to its poppet valve-closed position.

To initiate the return to the closed position, the fluid latch which has been preventing the fluid in chamber 10 from re-entering spring chamber 2 is released upon command by rapidly opening valve 4 allowing fluid to rapidly exit chamber 10 and return to spring chamber 2. Valve 4 may be constructed similar to the valve 5, but controls but a single conduit. During the return trip, the actuator again assumes the mid-way configuration of FIG. 4. The work of the expanding fluid from spring chamber 3 driving piston 6 has pressurized spring chamber 2 to about 1500 psi at this mid-way position. A short time later, the three-way valve 5 is reset to its initial (FIG. 2) position. This valve is reset to allow addition of supplemental energy through pre-pressurization by valving the 3000 psi high pressure source 12 into chamber 11 through $V_3$. This addition of supplemental energy should be accomplished at exactly the right time to assure that enough boost energy is transferred to the piston 6 to counteract the effects of fluid and mechanical friction and to maintain a smooth slow down and transition of the poppet valve into its seat 16. A very short time before the chamber 11 is pressurized, the valve $V_2$ closes disconnecting chamber 11 from spring chamber 3 to prevent its pressurization and valve $V_4$ opens to reset the pressure in spring chamber 3 at 500 psi.

The actuator has now returned to the configuration of FIG. 1 and has precompressed the fluid in spring chamber 2 to 2500 psi with chamber 11 pressurized to 3000 psi and the actuator will remain in this position holding the poppet valve closed against its seat 16 until another command is received.

Figure 7:
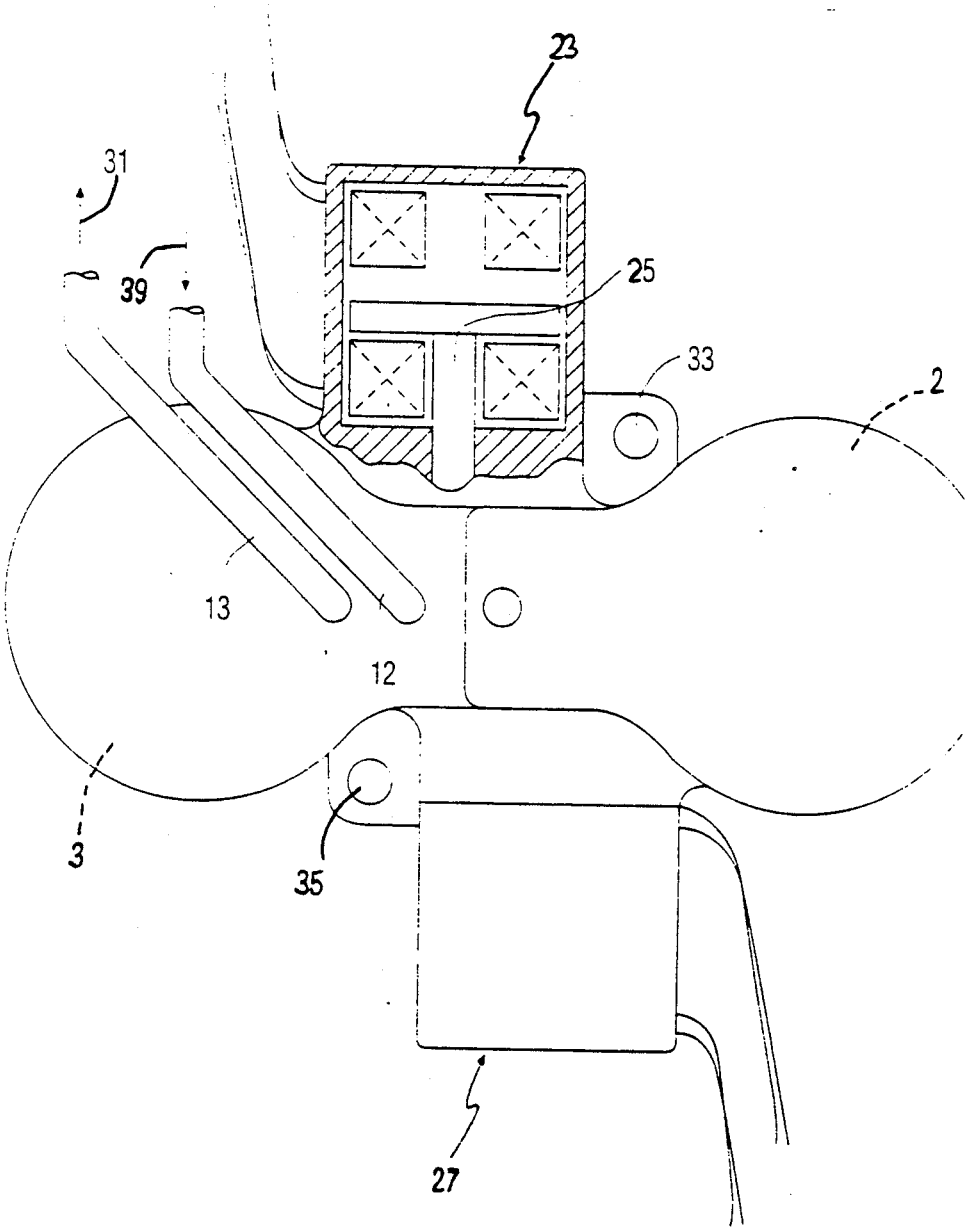
FIG. 7 is a top view, partially in cross-section, of the actuator of FIG. 1, 4 and 5.

In FIG. 7, a double acting solenoid 23 has a shaft 25 which connects to and actuates slide valve 5. Solenoid 27 actuates valve 4 somewhat similarly. High pressure fluid from the hydraulic pump is supplied to inlet conduit 12 as indicated by arrow 29 and conduit 13 provides a low pressure fluid return line back to the pump as indicated by arrow 31. A pair of mounting holes 33 and 35 for receiving mounting bolts such as 37 in FIGS. 1, 4 and 5 are also visible.

Figure 6:
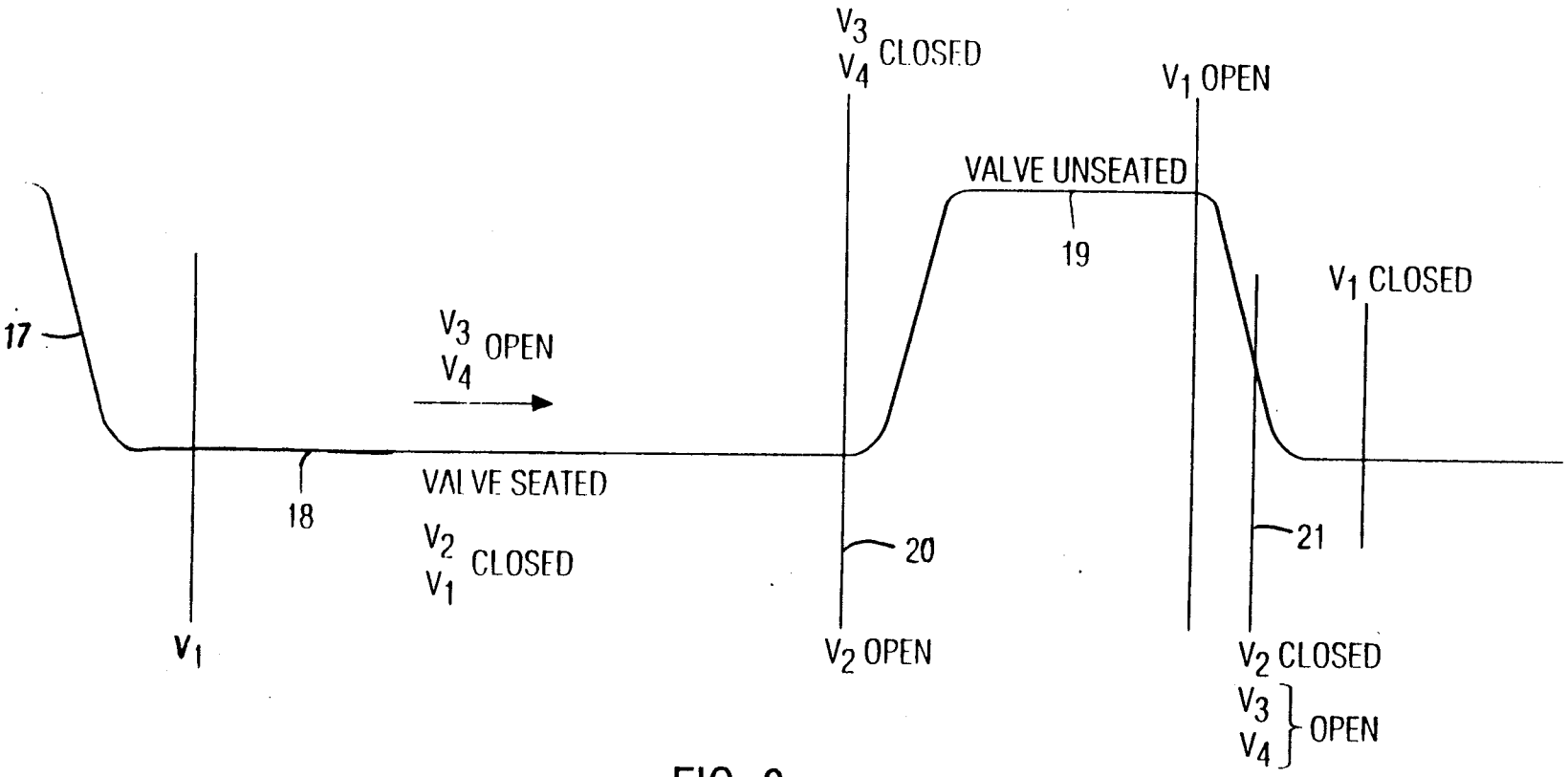
FIG. 6 is a presentation of a complete cycle of poppet valve displacement as a function of time showing the status of various valves therealong.

FIG. 6 is a basic timing diagram showing the times at which valves 4 and 5 should open and close relative to the opening and closing of the poppet valve. The trace 17 depicts poppet valve motion with the valve closed during the lower portion 18 of its movement profile and open during the upper portion 19. $V_3$ and $V_4$ are both open while $V_2$ is closed (the FIG. 2 condition) during the time the poppet valve is closed. Opening of the poppet valve is initiated at vertical line 20 where valve 5 transitions from its FIG. 2 state to its FIG. 3 state whereupon the poppet valve rapidly opens and remains open until valve 4 ($V_1$) is opened allowing the poppet valve to reclose. Valve 5 is reset at vertical line 21 to its FIG. 2 condition when the poppet valve is slightly past its half open position. A short time later after it is certain that the poppet valve has closed, valve 4 ($V_1$) is reclosed to prepare the spring chamber 2 for the next transit.

From the foregoing, it is now apparent that a novel hydraulically powered, hydraulically latched valve actuator mechanism employing hydraulic springs for motion damping and energy recovery has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. An electrically controlled hydraulically powered internal combustion engine valve actuator comprising:

a valve actuator housing;

a power piston having a pair of opposed primary working surfaces for receiving hydraulic fluid pressure for moving the piston within the housing back and forth along an axis; and first and second hydraulic fluid chambers comprising a pair of cavities within the housing of substantially the same relatively fixed volume the first chamber supplying pressurized fluid to one piston surface and the second chamber receiving fluid displaced by the other piston surface as the piston moves in one direction along the axis, the second chamber supplying pressurized fluid to the other piston surface and the first chamber receiving fluid displaced by the one piston surface as the piston moves in the opposite direction along the axis.

2. The electrically controlled hydraulically powered valve actuator of claim 1 wherein the pressure in one chamber increases as the pressure in the other chamber decreases.

3. The electrically controlled hydraulically powered valve actuator of claim 1 further comprising a high pressure hydraulic fluid source; a low pressure hydraulic fluid return; and a two position, three function valve operable in one position to supply high pressure hydraulic fluid from the source to one piston surface and to connect one chamber to the low pressure return.

4. The electrically controlled hydraulically powered valve actuator of claim 3 wherein the two position, three function valve is operable in the other of its positions to disconnect the high pressure hydraulic fluid source from the one piston surface and to disconnect the one chamber from the low pressure return, and thereafter to couple said one chamber with the said one piston surface to relieve the pressure therefrom.

5. The electrically controlled hydraulically powered valve actuator of claim 4 wherein the other said chamber contains relatively high pressure hydraulic fluid and is in fluid communication with the other piston surface when the two position valve is moved from said one position to the other of its positions thereby powering the piston from one position to another.

6. A hydraulically actuated transducer comprising:

a transducer housing;

a member reciprocable within the housing along an axis, said member having a pair of opposed primary working surfaces for receiving hydraulic fluid pressure for moving the member along the axis;

a high pressure hydraulic fluid source;

a low pressure hydraulic fluid sink;

a first hydraulic fluid control valve for supplying source pressure to one working surface to maintain the member at one of its extreme positions along the axis;

means for selectively actuating the control valve to release the high pressure from said one working surface allowing a flow of high pressure hydraulic fluid to the other of the primary working surfaces to move the member from said one extreme position to the other; and first and second hydraulic fluid chambers, the first chamber supplying pressurized fluid to one working surface and the second chamber receiving fluid displaced by the other working surface as the member moves in one direction along the axis, the second chamber supplying pressurized fluid to the other working surface and the first chamber receiving fluid displaced by the one working surface as the member moves in the opposite direction along the axis.

7. The hydraulically actuated transducer of claim 6 wherein the pressure in one chamber increases as the pressure in the other chamber decreases.

8. The hydraulically actuated transducer of claim 6 further comprising a two position, three function valve operable in one position as said first hydraulic fluid control valve and to connect one chamber to the low pressure sink.

9. The hydraulically actuated transducer of claim 8 wherein the two position, three function valve is operable in the other of its positions to disconnect the high pressure hydraulic fluid source from the one working surface and to disconnect the one chamber from the low pressure sink, and thereafter to couple said one chamber with the said one working surface to relieve the pressure therefrom.

10. The hydraulically actuated transducer of claim 9 wherein the other said chamber contains relatively high pressure hydraulic fluid and is in fluid communication with the other working surface when the two position valve is moved from said one position to the other of its positions thereby powering the member from one position to another.

* * * * *